United States Patent [19]

Krause

[11] 4,251,013

[45] Feb. 17, 1981

[54] STORAGE VESSEL

[76] Inventor: Walter Krause, Walheim, Fed. Rep. of Germany

[21] Appl. No.: 48,432

[22] Filed: Jun. 14, 1979

[30] Foreign Application Priority Data

Aug. 30, 1978 [DE] Fed. Rep. of Germany ..... 2837724

[51] Int. Cl.[3] ..... B65G 65/40

[52] U.S. Cl. ..... 222/198; 222/203

[58] Field of Search ..... 222/196, 198, 199, 200, 222/202, 203, 195

[56] References Cited

U.S. PATENT DOCUMENTS

| | | | |
|---|---|---|---|
| 2,732,099 | 1/1956 | Davis | 222/203 X |
| 3,144,176 | 8/1964 | Grönkvist | 222/203 X |
| 3,669,317 | 6/1972 | Ivchenko | 222/195 |

*Primary Examiner*—Allen N. Knowles

*Attorney, Agent, or Firm*—Michael J. Striker

[57] ABSTRACT

A storage vessel includes a housing which has an inlet for introducing flowable particulate material into, and an outlet for withdrawing the same from the housing. At least one expandable cushion is located inside the housing and is operative for expanding and collapsing so as to agitate the material contained in the housing to thereby prevent agglomeration of the material. Air is introduced into the cushion to expand the same.

16 Claims, 5 Drawing Figures

STORAGE VESSEL

BACKGROUND OF THE INVENTION

The present invention relates to storage vessels.

More particularly, the present invention is concerned with a storage vessel for flowable particulate material, such as flour or the like.

It is known in the prior art to provide a storage vessel which has a vertical cylindrical housing which may be suspended on a support. An upper portion of the housing is formed with an opening for introducing the particulate material in the housing. A lower portion of the housing forms a funnel with an outlet for withdrawing the particulate material from the housing.

The flowable particulate material tends to develop agglomeration in the housing in general and in the lower portion thereof (i.e. the funnel) near the outlet in particular. Obviously, the material agglomeration may disadvantageously prevent the flow of the material from the housing.

It is known in the prior art to provide different devices for agitating the flowable particulate material in the housing so as to prevent agglomeration of the material.

It has been suggested to periodically blow air into the housing so as to agitate (i.e. vibrate) the flowable particulate material contained in the housing. It is preferable to blow air in the housing at the lower portion thereof where the agglomeration development is most likely to occur.

It has been recognized, for example, that by making the housing of elastomeric yielding material one can substantially eliminate the agglomeration development in the housing. Such an arrangement not only precludes the agglomeration development but also provides significant hygiene advantages.

It has also been suggested to provide the outer surface of the housing with air-permeable pockets with air-distributing pads accommodated therein. Air is supplied via pipe connections which open into the pockets. When the air is blown through the respective pipe connections into the pockets, the pads distribute the air over a large area through the wall of the housing into the interior thereof, that is in a direct contact with the flowable material. Such air distribution in the flowable material ensures an adequate fluidity of the latter inside the housing and prevents agglomeration of the flowable material.

The disadvantage of this arrangement resides in the fact that the pockets have to be sewn and/or glued onto the outer surface of the housing. However, since the air is alternately introduced in the pockets via the respective pipe connections, the seams connecting the pockets to the outer surface of the housing undergo significant stresses. Obviously, these stresses in time may result in a situation wherein the seams are widened (i.e. stretched) and eventually the pockets may fall off the housing. In order to prevent these undesirable consequences, one has to periodically check and adjust (i.e. repair) the connection between the pockets and the outer surface of the housing.

In the case where the flowable material constitutes a comparatively delicate foodstuffs, such as corn-flour, the maintenance service has to be conducted under rather severe conditions which make the maintenance not only utmostly complicated and time-consuming, but also relatively expensive.

SUMMARY OF THE INVENTION

It is a general object of the present invention to avoid the disadvantages of the prior art storage vessels.

More particularly, it is an object of the present invention to provide a storage vessel with an arrangement for preventing agglomeration of flowable material in the vessel.

Another object of the present invention to provide an agglomeration-preventing arrangement which has a service life at least equal to that of the storage vessel itself.

In pursuance of these objects and others which will become apparent hereafter, one feature of the present invention resides in a storage vessel for flowable particulate material, comprising a housing having an inlet for introducing flowable particulate material into, and an outlet for withdrawing the same from the housing, and means for preventing agglomeration of the material inside the housing. The preventive means include at least one expandable cushion which is located inside the housing. The cushion is operative to agitate the material contained in the housing to thereby prevent agglomeration of the material. The storage vessel is further provided with means for expanding the cushion.

In accordance with another feature of the invention, the expanding means include a device for alternately introducing a pressure medium (e.g. gaseous substance, such as air) into and withdrawing the same from the cushion so that the latter expands and collapses, respectively.

In yet another feature of the invention, the cushion has a first wall which faces an inner surface of the housing and a second wall which faces away from the first wall. The first and second walls are connected (i.e. glued, or sewn) to each other at respective edge portions thereof. Both walls are made of elastomeric expandable material. When the cushion is in the collapsed position the first wall engages (i.e. stretches along) the inner surface of the housing and the second wall engages (i.e. stretches along) the first wall. When the pressure medium is introduced into the cushion, that is in a space between the first and second walls, the latter expand in the housing thus compressing the flowable particulate material contained in the housing. When the cushion collapses the previously compressed flowable material is permitted to flow in a free space which is left by the collapsed cushion. Thus, by alternately introducing and withdrawing the pressure medium into and out from the cushion, the flowable material is continuously agitated which, obviously, prevents the agglomeration of the material inside the housing.

In still another feature of the invention, the first wall is made of air in permeable material (i.e should the pressure medium be air), whereas the second wall is made of air-permeable material. Thus, the air introduced into the cushion enters into a direct contact with the flowable material through the second wall. Obviously, this direct integration of air right into the body of the material additionally agitates the latter and prevents the agglomeration of the material.

However, it is to be understood that the second wall may be made of air-impermeable material. In this case, air does not directly contact the flowable material.

It is true that a seam which connects the first and second walls of the cushion may become loosened (i.e.

stretched). However, since the cushion is inside the housing, such seam-loosening development does not negatively influence the function of the cushion, that is to prevent agglomeration of the flowable material inside the housing.

Thus, the above-mentioned disadvantages of the prior art storage vessels having the pockets outside the housing and the pockets per se are eliminated in the present invention. Instead, the expandable cushion (or cushions) is installed inside the housing and connected with a pipe connection extending through the wall of the housing so as to introduce the air into the cushion.

In a further feature of the invention, air distributing means are provided in the cushion between the first and second walls. The air distributing means include a pad of air-permeable material. The pad may be formed as a web of fibrous silver. The web may be manufactured of highly elastomeric resilient material so that when the air is introduced into the cushion, the web is deflected against its biasing force. When the air is released from the cushion, the web due to its inherent tengency to return to its unstressed position deflects back and abuts the first wall against the inner surface of the housing. Obviously, the impacts of the first wall of the cushion onto the inner surface of the housing advantageously vibrate the entire housing which vibrations are immediately transmitted onto the flowable material contained in the housing. Thus, the flowable material in the housing becomes additionally agitated.

In a preferred embodiment of the invention, there is provided a leaf spring in the cushion so as to normally urge the first wall towards and against the inner surface of the housing. In other words, when the pressurized air is introduced into the cushion, the first wall expands against the biasing force of the leaf spring. Once, the air pressure in the cushion reduces below the biasing force of the leaf spring, the latter abuts the first wall against the inner surface of the housing so that the latter and the flowable material contained therein vibrate.

It is to be understood, that the leaf spring and the web may be provided in the cushion together-in which case the impacts of the first wall against the inner surface of the housing are rather significant. However, the leaf spring and the web may be provided alternately in the cushion—in which case the respective impacts on the housing may be smaller. Moreover, the leaf spring and the web may be omitted all together. In the last case, the first and second wall (or at least one of them) should be made of an adequate resilient material so that once the air pressure in the cushion is sufficiently released, the first wall either by itself (i.e. without help of the second wall) or together with the second wall abuts the inner surface of the housing so as to vibrate the latter.

In yet another feature of the invention, the first wall of the cushion rigidly embraces the pipe connection for introducing the pressure medium into the cushion. The pipe connection has one end open into the cushion and another end open outwardly away and beyond the housing and may be connected a pressure medium (i.e. air) pump. The pipe connection has a longitudinal passage connecting the open-ends for guiding the pressure medium from outside the housing (i.e. from the air pump) into the cushion.

Should the second wall be made of air-impermeable material, the same pipe connection may be used for withdrawing the pressure medium from the cushion when the latter collapses.

In accordance with still another feature of the present invention, the pipe connection may have radial throughgoing bores which communicate with the longitudinal passage. The pipe connection is so arranged on the housing that the radial bores are open inside the housing in a space between the first wall of the cushion and the inner surface of the housing. When the first wall is expanded, the flowable material may develop agglomeration in the space between the inner surface of the housing and the first wall of the cushion. It is exactly the object of the radial boxes to allow the pressure medium (i.e. air) to enter this space so as to prevent such agglomeration of the flowable material in this space. The radial bores may be formed as nozzles so as to increase the pressure of the pressure medium exiting the nozzles.

Thus, should the first wall be pressed directly against the inner surface of the housing, the pressure of the exiting pressure medium is sufficient to penetrate between the outer surface of the first wall and the inner surface of the housing so as to agitate the flowable material contained in this region of the housing. Obviously, these jets additionally increase the effectiveness of the means for preventing agglomeration of the flowable material in the housing.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 2:
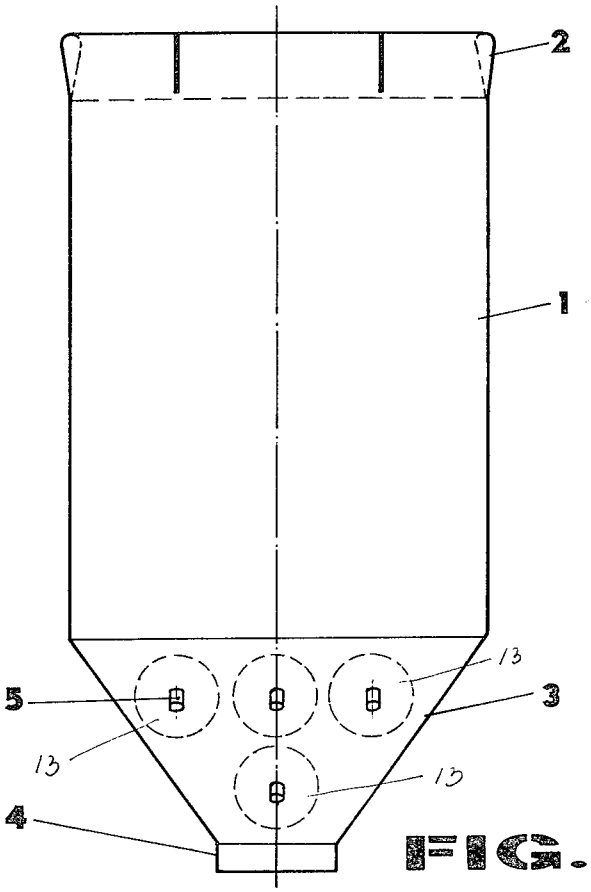
FIG. 2 is a front view of another embodiment of the storage vessel.
Figure 1:
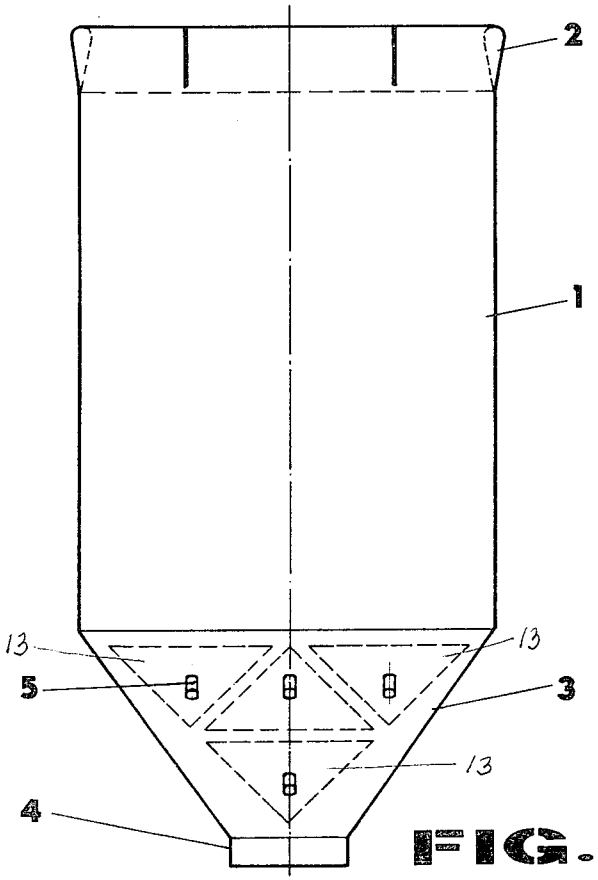
FIG. 1 is a front view of a storage vessel according to the present invention.

Referring now to the drawing and first to FIGS. 1 and 2 thereof, it may be seen that the reference numeral 1 designates a housing having an upper portion 2 to be suspended on a support (not shown) and a lower portion 3 which is shaped as a funnel provided with an outlet 4.

The reference numeral 5 designates pipe connections for introducing a pressure medium into the housing 1. The pipe connections 5 are connected to a source of the pressure medium, e.g. to an air pump. The air pump is known per se in the prior art, and therefore, does not require a detailed discussion or illustration.

Each pipe connection 5 is connected to an expandable cushion 13 which is operative for agitating flowable particulate material in the housing 1. The cushions 13 will be discussed in greater detail later on. They may be of a circular configuration (see FIG. 2), a triangular configuration (see FIG. 1) or any other.

The flowable material tends to develop inside the housing 1 agglomeration which may partially or entirely prevent the outflow of the material through the outlet 4.

It has been recognized that such agglomerations are most likely to develop at the lower portion of the housing 1 namely at the funnel 3. Therefore, it is advisable to arrange the pipe connections 5 and the cushions 13 at the funnel 3. However, the may also be provided anywhere along the housing 1.

Figure 3:
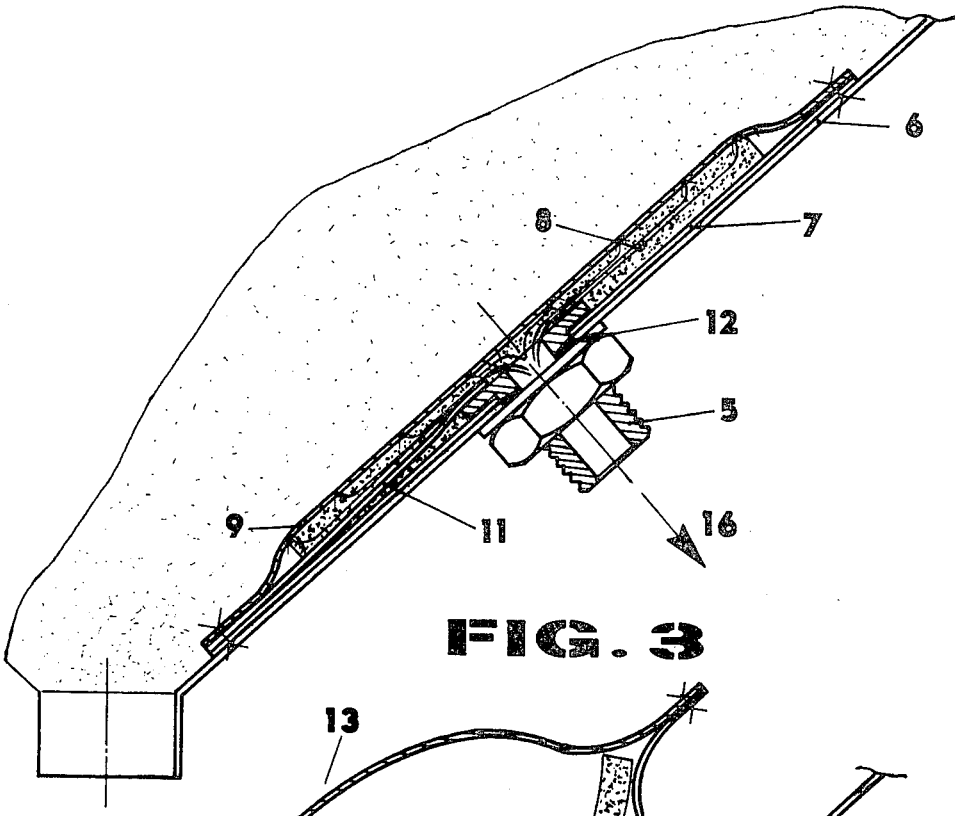
FIG. 3 is a section of a storage vessel with an arrangement of the present invention in a collapsible position.
Figure 4:
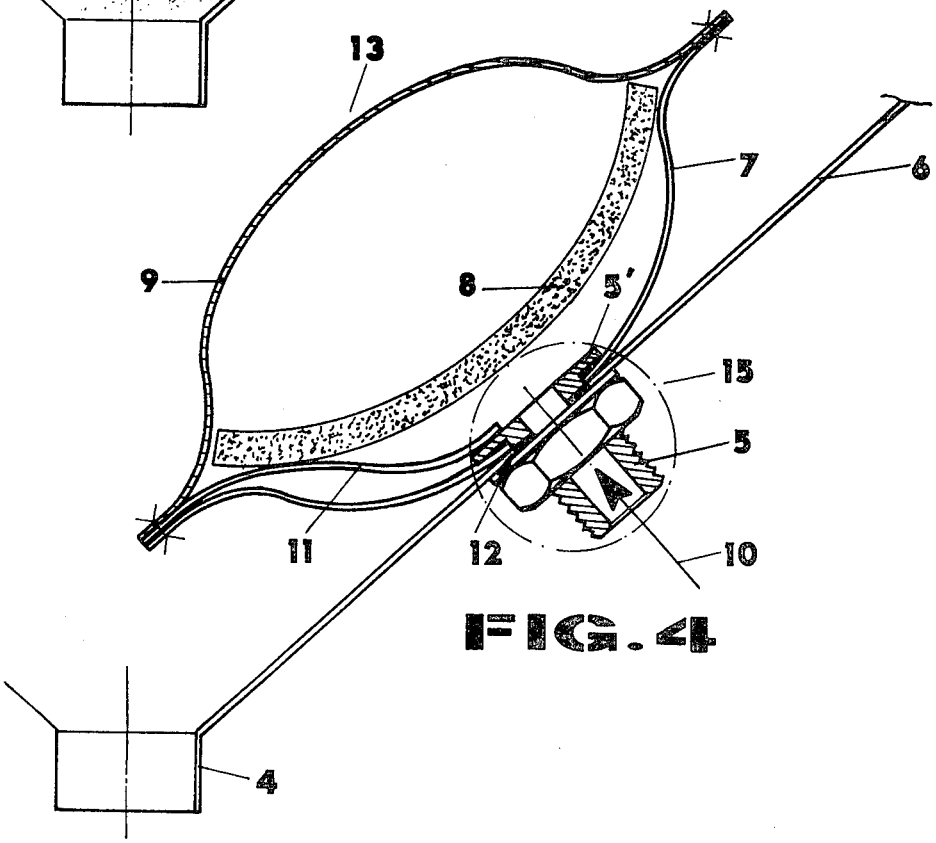
FIG. 4 is a section of the storage vessel with the arrangement of the present invention in an expandable position.

FIGS. 3 and 4 illustrate the pipe connection 5 which is fixedly mounted (i.e. screwed) on a wall 6 of the funnel 3.

A first wall 7 of the cushion 13 is pressed between a portion 5' of the pipe connection 5 and the inner surface of the wall 6. The first wall 7 is made of air-impermeable material. The cushion 13 further includes a second wall 9 which is fixedly connected (e.g. glued, sewn) to the first wall 6 at the circumferential edge portions thereof. The cushion 13 receives therein a web 8 of air-permeable material, for example, fibrous silver.

The second wall 9 of the cushion 13 may be of air-permeable material. In this case, the air introduced in the cushion 13 along an arrow 10 (see FIG. 4) through the pipe connection 5 flows through the web 8 (which substantially uniformly distributes the air over the interior of the cushion 13) and the second wall 9, and comes into a direct contact with the flowable material contained in the housing 1. The penetration of the air into the flowable material inside the housing 1 ensures the fluidity of the flowable material and prevents the agglomeration of the same in the housing 1. Thus, the flowable material inside the housing 1 may unobstructedly flow out of the housing 1 through the outlet 4 in the funnel 3.

In accordance with another embodiment of the present invention, the second wall 9 of the cushion 13 may be of air-impermeable material. In this case, the air flows through the pipe connection 5 and the web 8 and abuts (presses) against the inner surface of the round wall 9 without coming into the direct contact with the flowable material in the housing 1.

A leaf spring 11 is located inside the cushion 13 so as to normally urge the first wall 7 against the inner surface of the wall 6 of the funnel 3.

Thus, in an initial (i.e. unexpected) position shown in FIG. 3—the first wall 7 extends along the inner surface of the wall 6 of the funnel 3 and is urged in this position by the biasing force of the normally straight leaf spring 11. The web 8 and the second wall 9 extend substantially parallel to and along the elongation of the first wall 7.

Once the air is introduced into the cushion 13 through the pipe connection 5, the first wall 7 and the second wall 9 expand in a direction away from each other so as to increase the overall size of the cushion 13 (see FIG. 4). The wall 7 expands against the biasing force of the leaf spring 11 and deflects the latter.

After a predetermined amount of air introduced into the cushion 13, the supply of air is shut down.

In this case, should the second wall 9 be air-permeable, the air in the cushion 13 escapes therefrom into the interior of the housing 1 and penetrates into the flowable material contained therein.

Should the second wall 9 be of air-impermeable material, then air can exit from the cushion 13 in the direction indicated by arrow 16 (see FIG. 3).

In both cases, once the air pressure in the cushion 13 reduces below the biasing force of the spring 11, the latter urges the first wall 7 against the inner surface of the wall 6. The spring 11 may be so selected, that the impact on the inner surface of the wall 6 is strong enough to cause an additional agitation (i.e. vibration) of the housing 1 in general and the flowable material therein in particular.

Once the cushion 13 is collapsed, the air may be again introduced into the cushion 13 so as to expand the latter again. It is to be understood, that the processes of expanding and collapsing of the cushion 13 may alternately be repeated right one after another. Obviously, this significantly agitates the flowable material inside the housing 1 and prevents agglomeration of the material.

Figure 5:
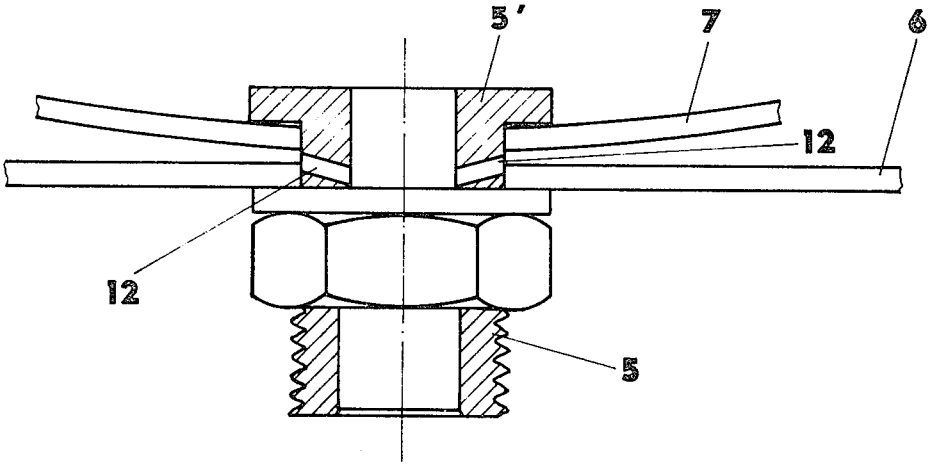
FIG. 5 is an enlarged view of a portion of the arrangement indicated by a reference numeral 15 in FIG. 4.

The pipe connection 5 is provided with radial throughgoing passages 12 (see FIGS. 4 and 5) which have one end open into the interior of the housing 1 between the outer surface of the first wall 7 and the inner surface of the wall 6 of the funnel 3 and another end communicating with a central longitudinal air passage of the pipe connection 5. Thus, when the air is introduced into the cushion 13 along the arrow 10 (see FIG. 4) and the first wall 7 expands in a direction away from the inner surface of the wall 6, there develops a space between the wall 7 and the wall 6. The flowable material may develop agglomerations in this space. The air exiting through the radial passages 12 into this space prevents any of such agglomeration of the flowable material.

It is to be understood that the spring 11 may be omitted. However, the function of the spring 11 may be accomplished by the web 8. For this purpose, the latter has to be made of a highly-resilient material so as to ensure a significant impact or the wall 6 by the wall 7 of the cushion 13 when the latter collapses. However, the same function may be accomplished by the first and second walls 7 and 9. In this case, the walls 7 and 9 have to be made of a highly-resilient material. However, it is also possible to provide only one wall (e.g. the second wall 9) of the highly-resilient material. In this case, the second wall 9 (which normally abuts the first wall 7 against the wall 6) will accomplish the impact on the wall 6 once the air is released from the cushion 13. Moreover, in order to increase the effectiveness of the impact on the wall 6 when the cushion collapses, all elements, namely the first and second walls 7 and 9, the web 8 may be made of highly-resilient material.

It is also possible to provide the cushion 13 (with or without the leaf spring 11) without the web 8. In this case, in order to ensure the uniform distribution of air inside the cushion 13, the latter has to have the corresponding configuration (see FIG. 1-for example).

It will be understood that each of the elements described above, or two or more together, may also find a useful application in other types of a storage vessel differing from the types described above.

While the invention has been illustrated and described as embodied in a storage vessel, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without emitting features that, from the standpoint of prior art, fairly constitute essential characteristics of the generic or specific aspects of this invention.

What is claimed as new and desired to be protected by Letters Patent is set forth in the appended claims:

1. A storage vessel for flowable particulate material, comprising a housing having an inlet for introducing flowable particulate material into the housing, and an outlet for withdrawing the same from the housing, said housing including a lower portion forming a funnel provided with said outlet; means for preventing agglomeration of the material inside the housing and including at least one expandable cushion located inside said housing and operative for expanding and collapsing so as to agitate the material contained in the housing to thereby prevent agglomeration of the material, said cushion including a first wall and a second wall fixedly connected to said first wall at edge portions thereof; expanding means for expanding said cushion including means for introducing a pressure medium into the cushion between said first and said second wall; and means for uniformly distributing the pressure medium in said cushion including a pad of the pressure medium permeable material inserted into said cushion between said first wall and said second wall thereof.

2. A vessel as defined in claim 1, wherein said pressure medium is gaseous substance.

3. A vessel as defined in claim 1, wherein said pressure medium is air.

4. A vessel as defined in claim 1, wherein said first wall is of pressure-medium non-permeable material.

5. A vessel as defined in claim 1, wherein said second wall is of pressure-medium permeable material.

6. A vessel as defined in claim 1, wherein said second wall is of pressure-medium non-permeable material.

7. A vessel as defined in claim 1, wherein said pad is of fibrous sliver.

8. A vessel as defined in claim 1, wherein said pressure medium introducing means include a pipe connection extending into said housing from the exterior thereof and having a throughgoing passage having one end open to the exterior of the housing and another end open into the interior thereof, said first wall being so fixed on said pipe connection that said other open end thereof is open into said cushion.

9. A storage vessel for flowable particulate material, comprising a housing having an inlet for introducing flowable particulate material into the housing, and an outlet for withdrawing the same from the housing, said housing including a lower portion forming a funnel provided with said outlet; means for preventing agglomeration of the material inside the housing and including at least one expandable cushion located inside said housing and operative for expanding and collapsing so as to agitate the material contained in the housing to thereby prevent agglomeration of the material, said cushion including a first wall and a second wall fixedly connected to said first wall at edge portions thereof; expanding means for expanding said cushion including means for introducing a pressure medium into the cushion between said first and said second wall; means for uniformly distributing the pressure medium in said cushion including a pad of the pressure medium permeable material inserted into said cushion between said first wall and said second wall thereof; and means for collapsing said cushion when the pressure medium is released therefrom, said collapsing means including resilient means in said cushion adapted to become stressed when the pressure of the pressure medium introduced into the cushion exceeds a predetermined biasing force of said resilient means, said resilient means abutting said first wall of said cushion against the inner surface of the housing when the pressure in said cushion is below said biasing force of said resilient means.

10. A vessel as defined in claim 9, wherein said resilient means include a spring normally urging said first wall of said cushion against said inner surface of the housing, said first wall expanding against the biasing force of said spring in response to the pressure medium introduced into said cushion.

11. A vessel as defined in claim 9, wherein said resilient means are formed by at least one of walls made of elastomeric resilient material.

12. A vessel as defined in claim 9, wherein said resilient means include a leaf spring.

13. A vessel as defined in claim 9, wherein said resilient means are formed by said pad made of elastomeric resilient material.

14. A storage vessel for flowable particulate material, comprising a housing having an inlet for introducing flowable particulate material into the housing, and an outlet for withdrawing the same from the housing, said housing including a lower portion forming a funnel provided with said outlet; means for preventing agglomeration of the material inside the housing and including at least one expandable cushion located inside said housing and operative for expanding and collapsing so as to agitate the material contained in the housing to thereby prevent agglomeration of the material, said cushion including a first wall and a second wall fixedly connected to said first wall at edge portions thereof; expanding means for expanding said cushion including means for introducing a pressure medium into the cushion between said first and said second wall; and means for uniformly distributing the pressure medium in said cushion including a pad of the pressure medium permeable material inserted into said cushion between said first wall and said second wall thereof, said pressure medium introducing means including a pipe connection extending into said housing from the exterior thereof and having a throughgoing passage having one end open to the exterior of the housing and another end open into the interior thereof, said first wall being so fixed on said pipe connection that said other open end thereof is open into said cushion; and additional means for preventing agglomeration of the flowable material in a space between the outer surface of said first wall and the inner surface of said housing.

15. A vessel as defined in claim 14, wherein said additional preventing means include throughgoing bores provided on said pipe connection and having a first end communicating with said passage and another end open into said space so that when said first wall expands in response to the pressure medium introduced into the cushion through said passage the pressure medium enters said space through said bores to thereby agitate the flowable material contained in said space.

16. A vessel as defined in claim 15, wherein said bores form jets so as to increase the pressure of the pressure medium exiting said jets into said space.

* * * * *